US011585067B2

(12) United States Patent
Fukuda

(10) Patent No.: US 11,585,067 B2
(45) Date of Patent: Feb. 21, 2023

(54) HYDRAULIC SYSTEM FOR WORKING MACHINE

(71) Applicant: KUBOTA CORPORATION, Osaka (JP)

(72) Inventor: Yuji Fukuda, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 188 days.

(21) Appl. No.: 17/077,314

(22) Filed: Oct. 22, 2020

(65) Prior Publication Data

US 2021/0123206 A1 Apr. 29, 2021

(30) Foreign Application Priority Data

Oct. 28, 2019 (JP) ..... JP2019-195519

(51) Int. Cl.

| | |
|---|---|
| ***E02F 9/22*** | (2006.01) |
| ***E02F 3/42*** | (2006.01) |
| ***E02F 9/20*** | (2006.01) |
| ***E02F 3/43*** | (2006.01) |

(52) U.S. Cl.

CPC ..... *E02F 3/422* (2013.01); *E02F 3/432* (2013.01); *E02F 9/2041* (2013.01); *E02F 9/2207* (2013.01); *E02F 9/2217* (2013.01); *E02F 9/2225* (2013.01); *E02F 9/2267* (2013.01); *E02F 9/2271* (2013.01); *E02F 9/2275* (2013.01); *F15B 2211/3059* (2013.01); *F15B 2211/625* (2013.01); *F15B 2211/7053* (2013.01); *F15B 2211/71* (2013.01); *F15B 2211/8616* (2013.01); *F15B 2211/88* (2013.01)

(58) Field of Classification Search

CPC ... E02F 9/2207; E02F 9/2217; F15B 2211/88; F15B 21/14

See application file for complete search history.

(56) References Cited

U.S. PATENT DOCUMENTS

| | | | | |
|---|---|---|---|---|
| 5,513,491 | A * | 5/1996 | Broenner | E02F 9/2207 60/413 |
| 2012/0251283 | A1* | 10/2012 | Violland | E02F 9/2207 414/815 |
| 2017/0159265 | A1* | 6/2017 | Tomita | E02F 9/2217 |

FOREIGN PATENT DOCUMENTS

| | | | |
|---|---|---|---|
| JP | 2018-59399 | A | 4/2018 |

* cited by examiner

*Primary Examiner* — Kenneth Bomberg
*Assistant Examiner* — Michael Quandt
(74) *Attorney, Agent, or Firm* — Greenblum & Bernstein, P.L.C.

(57) ABSTRACT

A hydraulic system includes a first supply line connecting a boom control valve and a bottom side of a boom cylinder, a second supply line connecting the boom control valve and a rod side of the boom cylinder, a leveling switch valve having: a first operating position allowing a leveling operation of a working tool; and a first stopping position allowing the leveling operation to stop, a ride controller including: a ride-control switch valve connected to a branched fluid line branched from the first supply line; and an accumulator configured to perform an anti-vibrating operation for suppressing a pressure fluctuation of the boom cylinder, and a drain fluid line to discharge operation fluid in a downstream section extending from the leveling switch valve to the rod side of the boom cylinder in the second supply line when the leveling switch valve is switched to the first stopping position.

19 Claims, 4 Drawing Sheets

HYDRAULIC SYSTEM FOR WORKING MACHINE

CROSS-REFERENCE TO RELATED APPLICATIONS

The present application claims priority under 35 U.S.C. § 119 to Japanese Patent Application No. P2019-195519, filed Oct. 28, 2019. The content of this application is incorporated herein by reference in their entirety.

BACKGROUND OF THE INVENTION

Field of the Invention

The present invention relates to a hydraulic system for a working machine.

Description of Related Art

Japanese Unexamined Patent Application Publication No. 2018-59399 is known as a hydraulic system for a working machine provided with a ride controller device and a horizontal motion section. The working device of Japanese Unexamined Patent Application Publication No. 2018-59399 includes a boom cylinder, a bucket cylinder, a boom control valve to control the boom cylinder, a bucket control valve to control the bucket cylinder, a first fluid line connecting the boom cylinder and the boom control valve, a second fluid line connected to the bucket control valve, a horizontal controller connected to the first and second fluid lines for horizontal operation of the bucket cylinder, a ride controller device connected to the boom cylinder, a third fluid line having one end connected to the ride controller device and the other end connected to the first fluid line between the horizontal controller and the boom control valve.

The ride controller device has an accumulator and a ride control valve capable of connecting the third fluid line, the boom cylinder, the accumulator and the drain fluid line, the ride control valve being switchable between a stop position where the boom cylinder and the accumulator are shut off and the third fluid line and the drain fluid line are shut off, and an operating position where the boom cylinder and the accumulator are connected and the third fluid line and the drain fluid line are connected.

SUMMARY OF THE INVENTION

A hydraulic system for a working machine, includes: a boom cylinder to move a boom up or down; a working tool cylinder to operate a working tool attached to the boom; a boom control valve to control the boom cylinder; a working tool control valve to control the working tool cylinder; a first supply line connecting the boom control valve and a bottom side of the boom cylinder; a second supply line connecting the boom control valve and a rod side of the boom cylinder; a leveling switch valve connected to a second supply line and having: a first operating position allowing a leveling operation of the working tool; and a first stopping position allowing the leveling operation to stop; a ride controller including: a ride-control switch valve connected to a branched fluid line branched from the first supply line; and an accumulator connected to the ride-control switch valve and configured to perform an anti-vibrating operation for suppressing a pressure fluctuation of the boom cylinder; and a drain fluid line to discharge operation fluid in a downstream section extending from the leveling switch valve to the rod side of the boom cylinder in the second supply line when the leveling switch valve is switched to the first stopping position.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
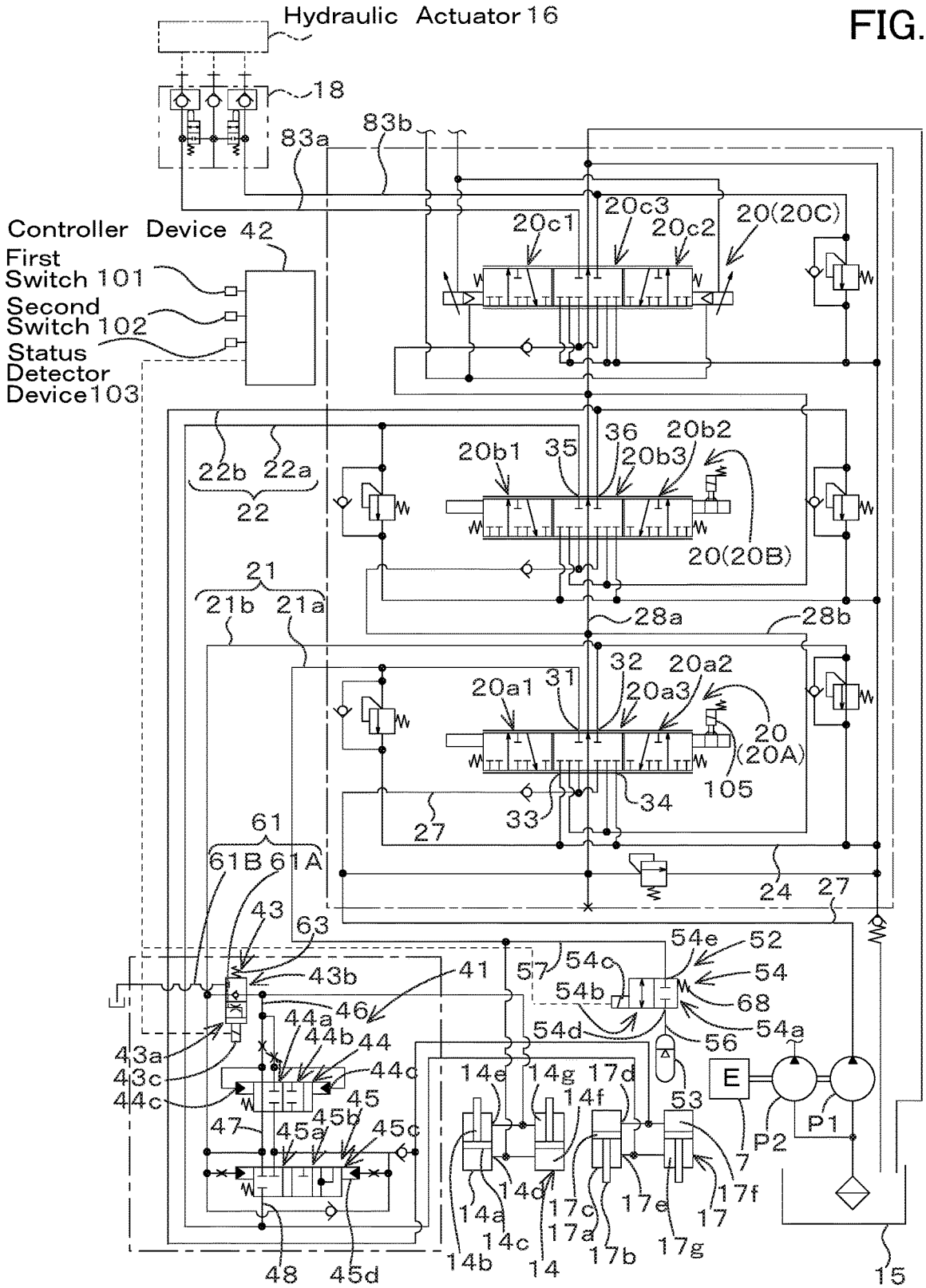
FIG. 1 is a view showing a hydraulic system (hydraulic circuit)

The embodiments of the present invention will now be described with reference to the accompanying drawings, wherein like reference numerals designate corresponding or identical elements throughout the various drawings. The drawings are to be viewed in an orientation in which the reference numerals are viewed correctly.

A hydraulic system for a working machine and a preferred embodiment of a working machine provided with the hydraulic system will be described below with reference to the drawings as appropriate.

Figure 3:
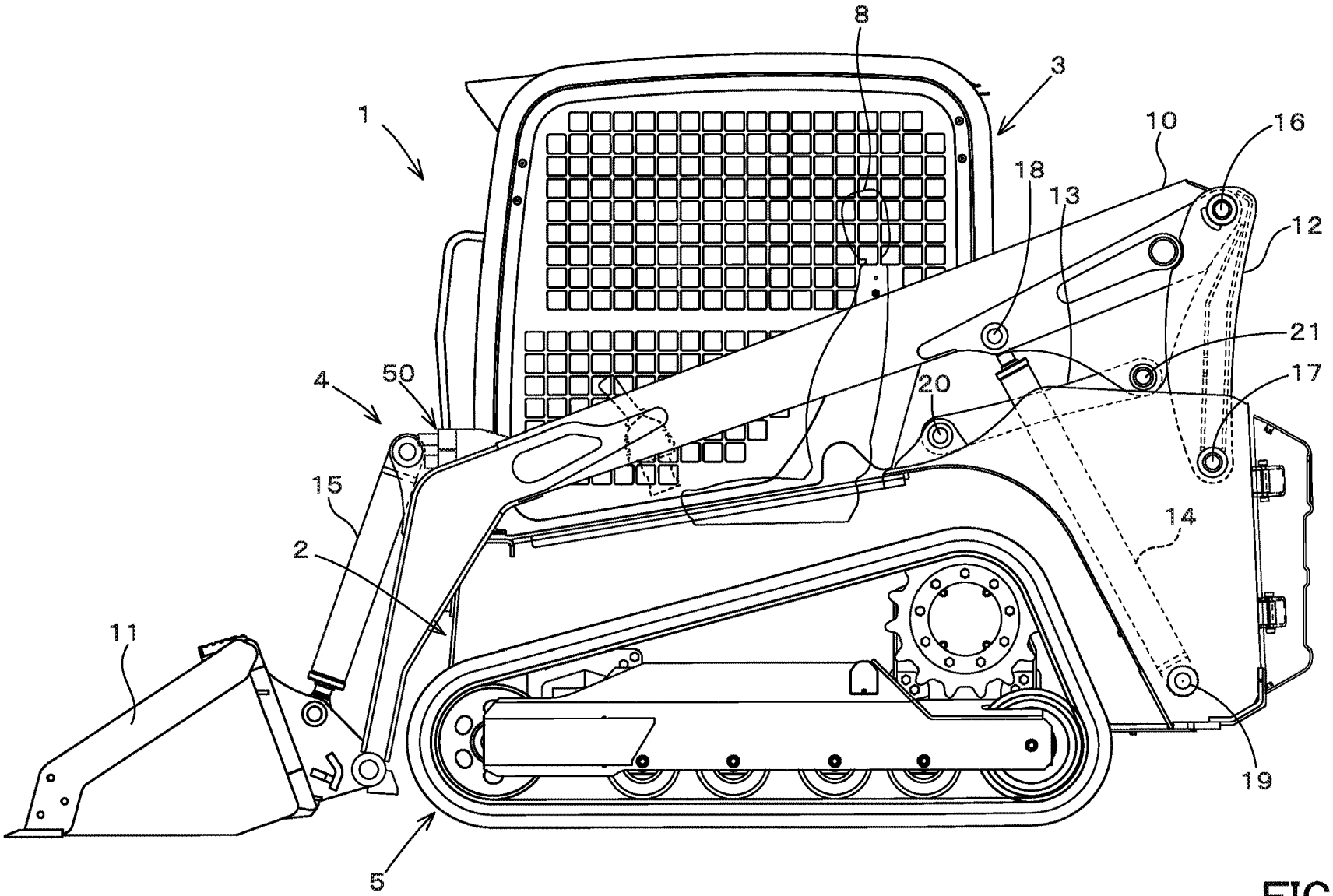
FIG. 3 is a whole view of a skid steer loader as an example of a working machine.

First, the working machine will be explained. FIG. 3 shows a side view of the working machine 1 in accordance with the present invention. In FIG. 3, a skid steer loader is shown as an example of the working machine 1. However, the working machine 1 in the present invention is not limited to a skid steer loader. For example, it may be another type of loader working device, such as a compact track loader. It may also be a working machine other than a loader working machine.

The working machine 1 is provided with a machine body (body) 2, a cabin 3, a working device 4, and traveling devices 5A and 5B.

The cabin 3 is mounted on the machine body 2. An operator seat 8 is provided at the rear portion of the cabin 3. In an embodiment of the present invention, the front side (the left side of FIG. 3) of the driver seated in the operator seat 8 of the working machine 1 is described as the front, the rear side (the right side of FIG. 3) of the driver is described as the rear, the left side (the front surface side of FIG. 3) of the driver is described as the left, and the right side (the back surface side of FIG. 3) of the driver is described as the right.

The horizontal direction, which is orthogonal to the front-rear direction, is explained as a machine width direction. The direction from the center to the right or left of machine body 2 is explained as a machine outward direction. In other words, the machine outward direction is the direction of the machine body width and away from the machine body 2. The direction opposite to the machine outward direction is described as a machine inward direction. In other words, the machine inward direction is the direction of the machine body width, which is approaching the machine body 2.

The cabin 3 is mounted on the machine body 2. The working device 4 is a device for performing work, and is mounted on the machine body 2. The traveling device 5A is a device for driving the machine body 2, and is installed on the left side of the machine body 2. Traveling device 5B is a device for traveling the machine body 2, and is installed on the right side of the machine body 2.

A prime mover 7 is provided at the rear of the machine body 2. The prime mover 7 is a diesel engine (engine). The motor 7 is not limited to an engine and may be an electric motor or the like.

A traveling lever 9L is provided on the left side of the operator seat 8. A traveling lever 9R is provided on the right side of the operator seat 8. The traveling lever 9L on the left side operates the left-side traveling device 5A, and the right-side traveling lever 9R operates the right-side traveling device 5B.

The working device 4 has a boom 10, a bucket 11, a lift link 12, a control link 13, a boom cylinder 14, and a working tool cylinder 17. The boom 10 is provided on the side of the machine body 2. The bucket 11 is provided at the end (front end) of the boom 10. A lift link 12 and a control link 13 support the base (rear) of the boom 10. A boom cylinder 14 moves the boom 10 up or down.

In detail, the lift link 12, the control link 13 and the boom cylinder 14 are provided on the side of the machine body 2. The upper portion of the lift link 12 is pivoted to the upper portion of the base of the boom 10. The lower portion of the lift link 12 is pivoted to the rear side of the machine body 2. The control link 13 is located forward of the lift link 12. One end of the control link 13 is pivoted to the bottom of the base of the boom 10 and the other end is pivoted to the machine body 2.

The boom cylinder 14 is a hydraulic cylinder that raises and lowers the boom 10. The upper portion of the boom cylinder 14 is pivoted to the front portion of the base of the boom 10. The lower portion of the boom cylinder 14 is pivoted to the rear side of the machine body 2. When the boom cylinder 14 is extended or shortened, the boom 10 is pivoted up and down by the lift link 12 and control link 13. The working tool cylinder 17 is a hydraulic cylinder that pivots the bucket 11.

The working tool cylinder 17 connects the left portion of the bucket 11 to the left boom and also connects the right portion of the bucket 11 to the right boom. Instead of the bucket 11, a working device such as a hydraulic crusher, a hydraulic breaker, an angle broom, an auger, a pallet fork, a sweeper, a mower, a snow blower, and the like, can be attached to the end (front) portion of the boom 10 instead of the bucket 11.

The traveling devices 5A and 5B are wheel-type traveling devices 5A and 5B having front wheels 5F and rear wheels 5R in this embodiment. Crawler-type (including semi-crawler-type) traveling devices 5A and 5B may be employed as the traveling devices 5A and 5B.

Next, a hydraulic circuit for working system (working hydraulic system) provided in the skid steer loader 1 will be described.

The working hydraulic system is a system for operating the boom 10, bucket 11, auxiliary attachments and the like, and is provided with a plurality of control valves 20 and a working hydraulic pump (first hydraulic pump) P1, as shown in FIG. 1. The working hydraulic system is also provided with a second hydraulic pump P2, which is different from the first hydraulic pump P1. It is also provided with a tank (hydraulic fluid tank) 15 for storing hydraulic fluid.

The first hydraulic pump P1 is a pump operated by the power of the prime mover 7 and is composed of a gear pump of a constant displacement type (a fixed displacement type). The first hydraulic pump P1 is capable of outputting hydraulic fluid stored in a tank (hydraulic fluid tank) 15. The second hydraulic pump P2 is a pump operated by the power of the prime mover 7 and includes a gear pump of the constant displacement type (a fixed displacement type).

The second hydraulic pump P2 is capable of outputting hydraulic fluid stored in the tank (hydraulic fluid tank) 15. The second hydraulic pump P2 discharges hydraulic fluid for signals and hydraulic fluid for control in the hydraulic system. The hydraulic fluid for signals and the hydraulic fluid for control is referred to as the pilot fluid.

A plurality of control valves 20 are valves that control various hydraulic actuators installed in the working machine 1. A hydraulic actuator is a device operated by hydraulic fluid and is a hydraulic cylinder, hydraulic motor, and the like. In this embodiment, the plurality of control valves 20 are a boom control valve 20A, a working tool control valve 20B, and a auxiliary control valve 20C.

The boom control valve 20A is a valve that controls the boom cylinder 14 that operates the boom 10. The boom control valve 20A is a direct-acting spool type three-position switching valve. The boom control valve 20A switches to a neutral position 20*a*3, a first position 20*a*1 different from the neutral position 20*a*3, and a second position 20*a*2 different from the neutral position 20*a*3 and the first position 20*a*1. In the boom control valve 20A, the switching of the neutral position 20*a*3, the first position 20*a*1 and the second position 20*a*2 is performed by moving the spool by operating the actuator 105.

The switching of the boom control valve 20A is performed by moving the spool directly through manually operation of the actuator 105. However, the spool may be moved by hydraulic operation (hydraulic operation by a pilot valve or by a proportional valve), by electrical operation (electrical operation by magnetization of a solenoid), or by other means.

The boom control valve 20A and the first hydraulic pump P1 are connected to the boom control valve 20A by means of the output fluid line 27. The hydraulic fluid discharged from the first hydraulic pump P1 passes through the output fluid line 27 and is supplied to the boom control valve 20A. The boom control valve 20A is connected to the boom cylinder 14 by the first fluid line 21.

In detail, the boom cylinder 14 is provided with a cylinder body 14*a*, a piston 14*c* provided axially movable in the cylinder body 14*a*, and a rod 14*b* connected to the piston 14*c*. The piston 14*c* divides the interior of the cylinder body (cylinder tube) 14*a* into a first fluid chamber 14*f* and a second fluid chamber 14*g*.

The first fluid chamber 14*f* is a fluid chamber on the bottom side (opposite to the rod side 14*b*) of the body of the cylinder 14*a*. The second fluid chamber 14*g* is the fluid chamber on the rod side of the cylinder body 14*a*. A port 14*d*, which is a port for supplying and draining hydraulic fluid and which is connected to the first fluid chamber 14*f*, is provided at the base end (opposite to the rod 14*b* side) of the body of the cylinder 14*a*. At the end of the cylinder body 14*a* (on the side of the rod 14*b*), a port 14*e* is provided at the end of the cylinder body 14*a* (on the side of the rod 14*b*), which is a port for supplying and draining hydraulic fluid and which is connected to the second fluid chamber 14*g*.

The first fluid line 21 has a first supply line 21*a* connecting the port 31 and the port 14*d* of the boom control valve 20A and a second supply line 21*b* connecting the port 32 and the port 14*e* of the boom control valve 20A.

Thus, if the boom control valve 20A is set to the first position 20*a*1, the hydraulic fluid can be supplied from the first supply line 21*a* to the port 14*d* (first fluid chamber 141) of the boom cylinder 14 and the hydraulic fluid can be drained from the port 14*e* (second fluid chamber 14*g*) of the boom cylinder 14 to the second supply line 21*b*.

This causes the boom cylinder 14 to extend and the boom 10 to rise. If the boom control valve 20A is set to the second position 20*a*2, hydraulic fluid can be supplied from the second supply line 21*b* to the port 14*e* (second fluid chamber 14*g*) of the boom cylinder 14 and hydraulic fluid can be drained from the port 14*d* (first fluid chamber 14*f*) of the boom cylinder 14 to the first supply line 21*a*. This causes the boom cylinder 14 to shorten and the boom 10 to lower.

The boom control valve 20A has a first discharge port 33 and a second discharge port 34. The first discharge port 33 and the second discharge port 34 are connected to the drain fluid line 24, which leads to the hydraulic fluid tank 15.

The working tool control valve 20B is a valve that controls the hydraulic actuator (working tool cylinder) 17 that operates the bucket 11. The working tool control valve 20B is a direct-acting spool-type three-position switching valve. The working tool control valve 20B switches to a neutral position 20*b*3, a first position 20*b*1 different from the neutral position 20*b*3, and a second position 20*b*2 different from the first position 20*b*1 and the neutral position 20*b*3.

In the working tool control valve 20B, the neutral position 20*b*3, the first position 20*b*1 and the second position 20*b*2 are switched by moving the spool by operating the actuator member.

The switching of the working tool control valve 20B is performed by moving the spool directly by manually operating the control member. However, the spool may be moved by hydraulic operation (hydraulic operation by a pilot valve or by a proportional valve), by electrical operation (electrical operation by magnetization of a solenoid), or by any other method.

The working tool control valve 20B and the boom control valve 20A are connected to the working tool control valve 20B by a first supply-drain fluid line 28*a* and a second supply-drain fluid line 28*b*. When the boom control valve 20A is in the neutral position 20*a*3, hydraulic fluid is supplied to the working tool control valve 20B via the first supply-drain fluid line 28*a*. When the boom control valve 20A is in the first position 20*a*1 or the second position 20*a*2, hydraulic fluid is supplied to the working tool control valve 20B via the second supply-drain fluid line 28*b*.

The working tool control valve 20B and the working tool cylinder 17 are connected by a second fluid line 22. In detail, the working tool cylinder 17 is provided with a cylinder body 17*a*, a piston 17*c* provided for axial movement in the cylinder 17*a*, and a rod 17*b* connected to the piston 17*c*.

The piston 17*c* partitions the interior of the cylinder body (cylinder tube) 17*a* into a first fluid chamber 17*f* and a second fluid chamber 17*g*. The first fluid chamber 17*f* is a fluid chamber on the bottom side (opposite to the rod 17*b* side) of the cylinder body 17*a*. The second fluid chamber 17*g* is the fluid chamber on the rod side of the body of the cylinder 17*a*.

The piston 17*c* partitions the interior of the cylinder body (cylinder tube) 17*a* into a first fluid chamber 17*f* and a second fluid chamber 17*g*. The first fluid chamber 17*f* is a fluid chamber on the bottom side (opposite to the rod 17*b* side) of the cylinder body 17*a*. The second fluid chamber 17*g* is the fluid chamber on the rod side of the body of the cylinder 17*a*. A port 17*d*, which is a port for supplying and draining hydraulic fluid and which is connected to a first fluid chamber 17*f*, is provided at a base end (opposite to the rod 17*b* side) of the body of the cylinder 17*a*. At the end of the cylinder body 17*a* (on the rod 17*b* side), a port 17*e* is provided at the end of the cylinder body 17*a* (on the rod 17*b* side), which is a port for supplying and draining hydraulic fluid and which is connected to the second fluid chamber 17*g*.

The second fluid line 22 has a third supply line 22*a* connecting the port 35 and the port 17*e* of the working tool control valve 20B and a fourth supply line 22*b* connecting the port 36 and the port 17*d* of the working tool control valve 20B.

Thus, when the working tool control valve 20B is set to the first position 20*b*1, the hydraulic fluid can be supplied from the third supply line 22*a* to the port 17*e* (second fluid chamber 17*g*) of the working tool cylinder 17 (second fluid chamber 17*g*), and the hydraulic fluid can be drained from the port 17*d* (first fluid chamber 17*f*) of the working tool cylinder 17 to the fourth supply line 22*b*.

This causes the working tool cylinder 17 to shorten and the bucket 11 to scoop. When the boom control valve 20A is set to the second position 20*a*2, hydraulic fluid can be supplied from the fourth supply line 22*b* to the port 17*d* (first fluid chamber 171) of the working tool cylinder 17, and hydraulic fluid can be drained from port 17*e* (second fluid chamber 17*g*) of the working tool cylinder 17 to the third supply line 22*a*. This allows the working tool cylinder 17 to extend to perform the dumping operation.

The auxiliary control valve 20C is a valve that controls the hydraulic actuator (hydraulic cylinder, hydraulic motor, and the like) 16 mounted on the reserve attachment. The auxiliary control valve 20C is a direct-acting spool three-position switching valve of pilot-type. The auxiliary control valve 20C is switched to a neutral position 20C3, a first position 20C1 different from the neutral position 20C3, and a second position 20C2 different from the first position 20C1 and the neutral position 20C3.

In the auxiliary control valve 20C, the switching of the neutral position 20C3, the first position 20C1 and the second position 20C2 is performed by moving the spool by the pressure of the pilot fluid. A connection member 18 is connected to the auxiliary control valve 20C via the supply-drain fluid lines 83*a* and 83*b*. The connection member 18 is connected to the connection member 18 with a fluid line connected to the hydraulic actuator 16 of the auxiliary attachment.

Thus, when the auxiliary control valve 20C is set to the first position 20*c*1, hydraulic fluid can be supplied to the hydraulic actuator 16 of the auxiliary attachment from the supply-drain fluid line 83*a*. When the auxiliary control valve 20C is set to the second position 20*c*2, hydraulic fluid can be supplied to the hydraulic actuator 16 of the auxiliary attachment from the supply-drain fluid line 83*b*.

Thus, the hydraulic actuator 16 (auxiliary attachment) can be operated by supplying hydraulic fluid to the hydraulic actuator 16 from the supply-drain fluid line 83*a* or the supply-drain fluid line 83*b*.

As shown in FIG. 1, the hydraulic system for the working machine is provided with a ride controller device 52. The ride controller device 52 is a technology that suppresses the traveling vibration of the working machine 1 by suppressing the pressure fluctuations of the boom cylinder 14 (to control vibration of the machine body 2).

More specifically, when the bucket 11 vibrates up and down as the working machine 1 travels, a pressure fluctuation is caused in the first fluid chamber 14*f* (the bottom side fluid chamber) of the boom cylinder 14. This pressure fluctuation in the first fluid chamber 14*f* is suppressed by the ride controller device 52 (absorbed by the accumulator 53, which will be described later) to suppress the traveling vibration of the working machine 1.

The ride controller device 52 has an accumulator 53 and a ride control switching valve 54. The accumulator 53 is a pressure accumulator that absorbs pressure fluctuations in the first fluid chamber 14*f* of the boom cylinder 14.

The ride control switching valve 54 is connected to a branching fluid line 57 branched from the first supply line 21*a*. The ride control switching valve 54 is also connected to the fluid line 56 to which the accumulator 53 is connected. It is a switching valve that changes the ride controller device 52 to a stop state, which is a state in which the operation of the ride controller device 52 is stopped (without the ride control switching valve), and to an operating state, which is a state in which the ride controller device 52 is operated (with the ride control switching valve).

The ride control switching valve 54 is a two-position switching valve that can be switched between a second stop position 54*a*, which brings the ride controller device 52 to a stopping state, and a second operating position 54*b*, which brings the ride controller device 52 to an operating state.

The ride control switching valve 54 is, in this embodiment, an electromagnetic switching valve that is held in the second stop position 54*a* by a second biasing member 68, such as a spring, and is switched to the second actuated position 54*b* by magnetization of the solenoid 54*c*.

The ride control switching valve 54 has a port 54*d* and a port 54*e*. One end of the fluid line 56 is connected to the port 54*d*. The other end of the fluid line 56 is connected to the accumulator 53. One end of the branching fluid line 57 is connected to the port 54*e*. The other end of the branching fluid line 57 is connected to the first supply line 21*a*.

That is, the port 54*e* is connected to the first fluid chamber 14*f* of the boom cylinder 14 via the branching fluid line 57 and the first supply line 21*a*. In other words, the ride controller device 52 (ride control switching valve 54) is connected to the boom cylinder 14 (first fluid chamber 14*f*) via the bifurcated fluid line 57 and the first supply line 21*a*.

As shown in FIG. 1, the hydraulic system has a horizontal control valve 41. The horizontal control valve 41 is a horizontal control valve that performs horizontal operation (and other operations) of the working tool cylinder 17. The horizontal control valve 41 has a leveling switch valve 43, a first control valve 44, and a second control valve 45.

The leveling switch valve 43 is a valve that changes between a state of stopping the horizontal operation and a state of activating the horizontal operation. In particular, the leveling switch valve 43 is a valve (on-off valve) that switches the horizontal operation, for example, a two-position switching valve that can be switched between a first stop position 43*a*, which stops the horizontal operation, and a first operating position 43*b*, which activates the horizontal operation.

The leveling switch valve 43 does not have to be a switching valve and may be a proportional valve or any other valve. The leveling switch valve 43 is, in this embodiment, an electromagnetic switching valve that is held in the first operating position 43*b* by a first biasing member 63, such as a spring, and is switched to the first stop position 43*a* by magnetization of the solenoid 43*c*. The leveling switch valve 43 is provided in the middle of the first fluid line 21 (second supply line 21*b*).

Figure 2A:
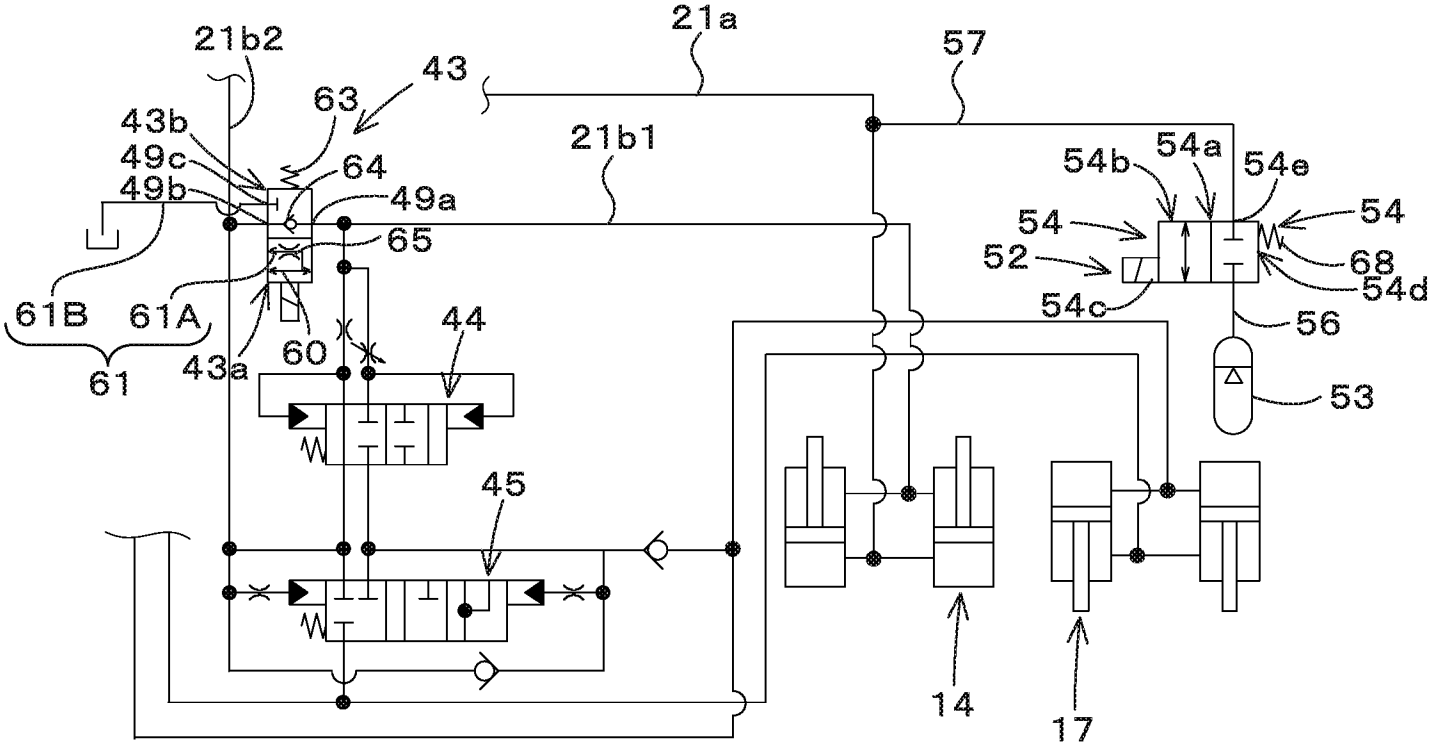
FIG. 2A is an enlargement view of a leveling switch valve and a ride-control switch valve.

As shown in FIG. 2A, the leveling switch valve 43 has a first port 49*a* and a second port 49*b*. The first port 49*a* is connected to the downstream section 21*b*1 from the leveling switch valve 43 to the rod side of the boom cylinder 14 in the second supply line 21*b* that connects the boom control valve 20A to the boom cylinder 14.

The second port 49*b* is connected to the upstream section 21*b*2 of the second supply line 21*b* to the leveling switch valve 43 boom control valve 20A. The leveling switch valve 43 is provided with a communicating fluid line 60 that connects the first port 49*a* and the second port 49*b* at the first stop position 43*a*.

The communicating fluid line 60 allows the flow of hydraulic fluid from the boom cylinder 14 back to the boom control valve 20A and from the boom control valve 20A to the boom cylinder 14 in the first fluid line 21 (second supply line 21*b*) at the first stop position 43*a*.

That is, the leveling switch valve 43 opens the middle portion of the first fluid line 21 (second supply line 21*b*) when the first stop position 43*a* is at the first stop position 43*a* to allow the mutual distribution of hydraulic fluid between the boom cylinder 14 side and the boom control valve 20A side. When the leveling switch valve 43 is at the first stop position 43*a*, no horizontal operation is performed.

The leveling switch valve 43 is provided with a check valve 64 that shuts off the first port 49*a* and the second port 49*b* when the first operating position 43*b* is in the first operating position 43. The check valve 64 blocks the flow of hydraulic fluid (return fluid) from the boom cylinder 14 back to the boom control valve 20A in the first fluid line 21 (second supply line 21*b*) and allows the flow of hydraulic fluid from the boom control valve 20A to the boom cylinder 14 when the first operating position 43*b* is in the first operating position 43. When the leveling switch valve 43 is in the first operating position 43*b*, the horizontal operation is on (horizontal operation is possible).

The first control valve 44 is a two-position switching valve that can be switched between the first position 44*a* and the second position 44*b*. The first control valve 44 is connected to the first fluid line 21 (second supply line 21*b*) by a first flow line 46 downstream of the first control valve 44 and the leveling switch valve 43 (on the boom cylinder 14 side). The pressure of the hydraulic fluid in the first channel 46 acts on the pressure receiver portion 44*c* of the first control valve 44.

The second control valve 45 is a three-position switching valve of the pilot switching type that can be switched between the first position 45*a*, the second position 45*b* and the third position 45*c*. The first control valve 44 and the second control valve 45 are connected by a second flow line 47, and the pressure of the hydraulic fluid in the second flow line 47 acts on the pressure receiver portion 45*d* of the second control valve 45.

The second flow line 47 is the first fluid line 21 (second supply line 21*b*), which is connected to the upstream side (boom control valve 20A side) of the leveling switch valve 43. The second control valve 45 and the second fluid line 22 (third supply line 22*a*) are connected to the second fluid line 22 (third supply line 22*a*) by a third flow line 48.

Thus, when the leveling switch valve 43 is set to the first operating position 43*b*, the return fluid from the boom cylinder 14 flows to the first control valve 45 and is distributed to the working tool cylinder 17 by the first control valve 45 and the second control valve 46. This keeps the bucket and other working tools, such as the bucket, horizontal while the boom 10 is being raised (performing horizontal operation). When the leveling switch valve 43 is set to the first stop position 43*a*, the horizontal operation is stopped by preventing the return fluid from flowing to the first control valve 45 by means of the connecting fluid line 60.

Figure 2B:
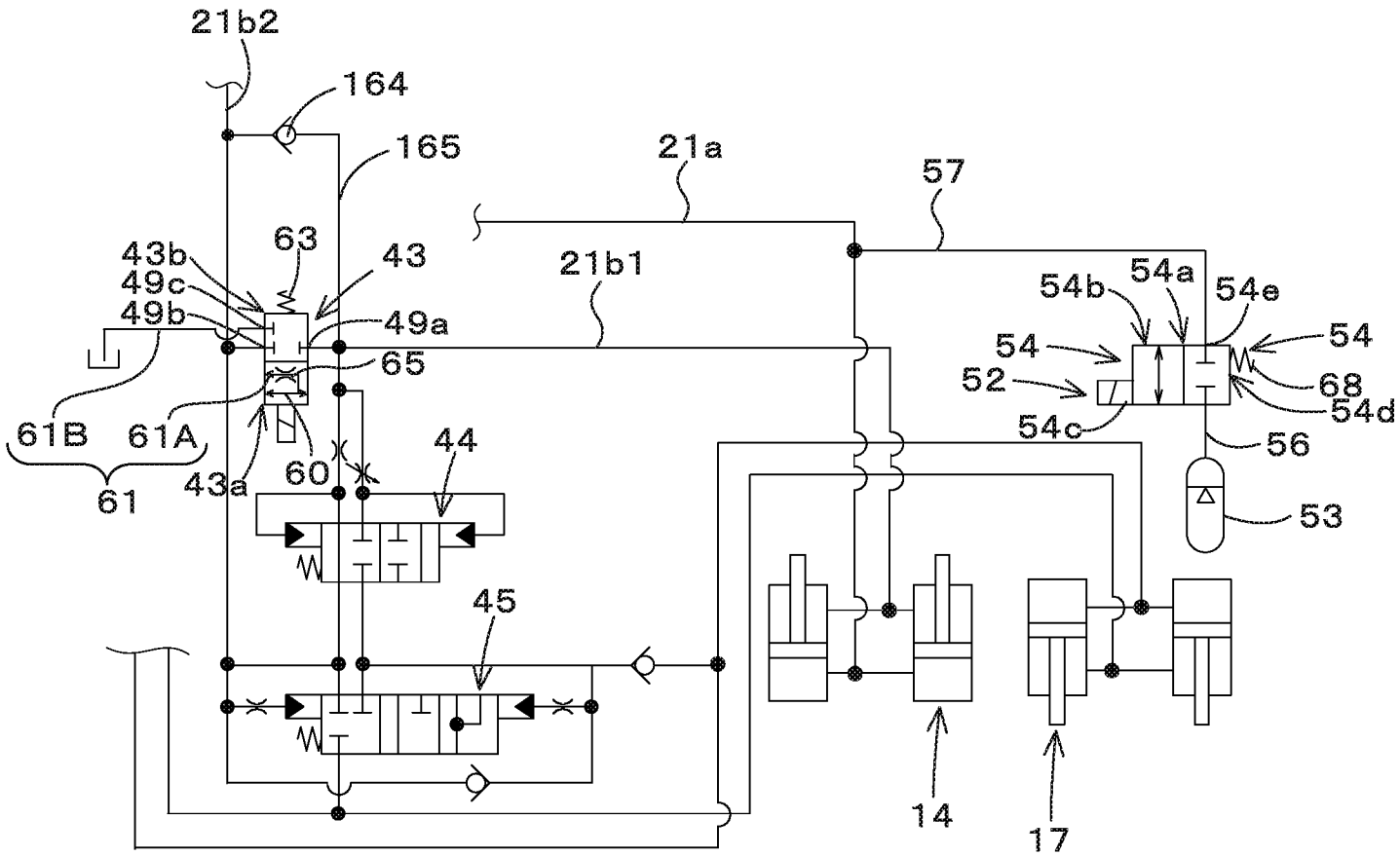
FIG. 2B is an enlargement view of a leveling switch valve and a ride-control switch valve different from those of FIG. 2A.

The leveling switch valve 43 of FIG. 2A was provided with a check valve 64 to shut off the first port 49*a* and the second port 49*b* when it is in the first operating position 43*b*. However, instead, as shown in FIG. 2B, the leveling switch valve 43 of FIG. 2B may be configured to shut off the first port 49*a* and the second port 49*b* when it is in the first operating position 43*b* without a check valve 64 inside the leveling switch valve 43 of FIG. 2B.

In this case, a bypass fluid line 165 is provided to bypass the leveling switch valve 43 and to bypass the downstream section 21*b*1 and the upstream section 21*b*2. The bypass fluid line 165 is provided with a check valve 164 that permits operation fluid to flow from the upstream section 21*b*2 to the downstream section 21*b*1 and prevents operation fluid from the downstream section 21*b*1 to the upstream section 21*b*2.

Now, as shown in FIG. 1 and FIG. 2, the hydraulic system for the working machine is provided with a drain fluid line 61. The drain fluid line 61 is provided with a throttle portion 65 (a throttle portion with a smaller cross-sectional area than the rest of the system) that reduces the flow rate of the hydraulic fluid.

The drain fluid line 61 is capable of outputting hydraulic fluid in the second supply line 21*b* (downstream section 21*b*1) when the leveling switch valve 43 is in the first stop position 43*a*. In detail, as shown in FIG. 2, the leveling switch valve 43 has a third port 49*c*, the third port 49*c* outputting the hydraulic fluid passing through the leveling switch valve 43 into the drain fluid line 61, which is external.

The drain fluid line 61 includes an internal drain fluid line 61A and an external drain fluid line 61B. The internal drain fluid line 61A is provided inside the leveling switch valve 43 and discharges a portion of the hydraulic fluid passing through the leveling switch valve 43 to the third port 49*c* when the valve is in the first stop position 43*a*.

The internal drain fluid line 61A is a fluid line branched from the communicating fluid line 60, and discharges the hydraulic fluid that has passed through the first port 49*a* and the communicating fluid line 60 through the third port 49*c*. The external drain fluid line 61B discharges to the discharge portion of the hydraulic fluid tank 15 or the like when it is in the first stop position 43*a*.

In the above-described embodiment, a portion of the drain fluid line 61 is provided inside the leveling switch valve 43, but this is not limited to this, and the drain fluid line 61 can be a fluid line that discharges the hydraulic fluid in the downstream section 21*b*1 when the leveling switch valve 43 is in the first stop position 43*a*.

The hydraulic system for the working machine is provided with a controller device 42. The controller device 42 is a device for various controls of the working machine, for example, the prime mover 7, the horizontal control valve 41, and the like. The controller device 42 is connected to a first switch 101, a second switch 102, and a state detector device 103.

The first switch 101 is, for example, a switch that can be switched ON/OFF and is located around the operator seat 8. The ON/OFF switching of the first switch 101 can be manually switched by the driver. When the first switch 101 is ON, permission for horizontal operation is commanded to the controller device 42, and when the first switch 101 is OFF, non-permission for horizontal operation is commanded to the controller device 42.

The second switch 102 is, for example, a switch that can be switched ON/OFF and is located around the operator seat 8. The ON/OFF switching of the second switch 102 can be manually switched by the driver. When the second switch 102 is ON, permission to control vibration control operation is commanded to the controller device 42, and when the second switch 102 is OFF, non-permission of vibration control operation is commanded to the controller device 42.

The status detector device 103 is a device that detects at least one of the operations and movements of raising the boom 10. The status detector device 103 includes a boom detector device that detects the raising of the boom 10.

The boom detector device includes, for example, a sensor that detects that the control lever operating the boom 10 is operated in the upward direction, an angle detection sensor that detects that the angle of the boom 10 with respect to the machine body 2 is on the upward side of the boom 10, a telescopic detection sensor that detects that the boom cylinder 14 extends and shortens on the upward side of the boom 10.

When the first switch 101 is ON and the rising of the boom 10 is detected by the status detector device 103, for example, the controller 42 switches the leveling switch valve 43 from the first stop position 43*a* to the first operating position 43*b*.

On the other hand, when the second switch 102 is ON, the leveling switch valve 43 is switched to the first stop position 43*a* regardless of whether the first switch 101 is ON or OFF. When the second switch 102 is ON, the horizontal operation may be performed when the first switch 101 is ON, but is not limited thereto.

The hydraulic system for the working machine, includes the boom cylinder 14 to move the boom 10 up or down, the working tool cylinder 17 to operate the working tool attached to the boom 10, the boom control valve 20A to control the boom cylinder 14, the working tool control valve 20B to control the working tool cylinder 17, the first supply line 21*a* connecting the boom control valve 20A and a bottom side of the boom cylinder 14, the second supply line 21*b* connecting the boom control valve 20A and a rod side of the boom cylinder 14, the leveling switch valve 43 connected to the second supply line 21*b* and having the first operating position 43*b* allowing a leveling operation of the working tool, and the first stopping position 43*a* allowing the leveling operation to stop, the ride controller 52 including the ride-control switch valve 54 connected to a branched fluid line 57 branched from the first supply line 21*a*, and the accumulator 53 connected to the ride-control switch valve 54 and configured to perform an anti-vibrating operation for suppressing a pressure fluctuation of the boom cylinder 14, and the drain fluid line 61 to discharge operation fluid in the downstream section extending from the leveling switch valve 43 to the rod side of the boom cylinder 14 in the second supply line 21*b* when the leveling switch valve 43 is switched to the first stopping position 43*a*.

According to this configuration, by switching the leveling switch valve 43 to the first stop position 43*a* with the bottom side of the boom cylinder 14 connected to the accumulator 53, the hydraulic fluid in the port 14*e* (second fluid chamber 14*g*) of the boom cylinder 14 is drained by switching the leveling switch valve 43 to the first stop position 43*a* with the bottom side of the boom cylinder 14 connected to the accumulator 53. In other words, the boom cylinder 14 can be controlled to prevent vibration.

The control of the boom cylinder 14 can also be performed by placing the leveling switch valve 43 in the first operating position 43*b* with the bottom side of the boom cylinder 14 connected to the accumulator 53. In other words, the leveling switch valve 43 can be easily switched to control the vibration control operation by switching the leveling switch valve 43.

The drain fluid line 61 is provided with a throttle portion 65. According to this configuration, since the drain fluid line 61 is provided with a throttle portion 65, the hydraulic fluid discharged from the drain fluid line 61 can be adjusted, and thus stable vibration control can be performed.

The leveling switch valve 43 has the first port 49*a* connected to the downstream section of the second supply line 21*b*, the second port 49*b* connected to the upstream section of the second supply line 21*b* from the leveling switch valve 43 to the boom control valve 20A, and the third port 49*c* through which the hydraulic fluid of the drain fluid line 61 passes. When the leveling switch valve 43 is in the first stop position 43*a*, the first port 49*a*, the second port 49*b* and the third port 49*c* are connected together, and when the leveling switch valve 43 is in the first operating position 43*b*, the first port 49*a* and the second port 49*b* are shut off.

According to this configuration, by making the leveling switch valve 43 in the first stopping position 43*a*, a part of the hydraulic fluid in the downstream section of the second supply line 21*b* can be drained out of the downstream section of the second supply line 21*b* for vibration control action, while horizontal operation can also be performed when the leveling switch valve 43 is in the first operating position 43*b*.

The drain fluid line 61 is provided in the leveling switch valve 43 and has an internal drain fluid line 61A for discharging a portion of the hydraulic fluid passing through the leveling switch valve 43 when the valve is in the first stop position 43*a*, and an external drain fluid line 61B for discharging the hydraulic fluid in the internal drain fluid line 61A to the outside.

According to this configuration, the hydraulic fluid on the rod side of the boom cylinder 14 can be drained through the internal drain fluid line 61A and external drain fluid line 61B during vibration control operations.

The leveling switch valve 43 has the check valve 64 that prevents the hydraulic fluid in the downstream section from flowing to the boom control valve 20A when it is in the first operating position 43B. Accordingly, the check valve 64 allows for a state of horizontal operation to be performed by the check valve 64.

The ride control switching valve 54 is switchable between a second stop position 54*a* for stopping the vibration control operation and a second operating position 56*b* for the vibration control operation, and the leveling switch valve 43 is switched to the first stop position 43*a* when the ride control switching valve 54 is in the second operating position 56*b*.

According to this configuration, the ride control switching valve 54 can be easily controlled by switching the ride control switching valve 54 to the second operating position 56*b*.

The leveling switch valve 43 has a first biasing member 63 which is actuated toward the first stop position 43*a*, and the ride control switching valve 54 has a second biasing member 68 which is actuated toward the second stop position 54*a*.

According to this configuration, by means of the first and second biasing members 63 and 68, it is possible to actuate the horizontal movement in the initial state, while stably holding the vibration control action in a stopped state.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

In the above-described embodiment, the hydraulic fluid is discharged from the hydraulic fluid tank, but it may be at any other location. That is, the fluid line for draining the hydraulic fluid may be connected to a place other than the hydraulic fluid tank, for example, it may be connected to the suction portion of the hydraulic pump (the portion that draws the hydraulic fluid) or to some other part of the hydraulic pump.

What is claimed is:

1. A hydraulic system for a working machine, comprising:

a boom cylinder to move a boom up or down, the boom cylinder including a bottom-side fluid chamber and a rod-side fluid chamber;

a working tool cylinder to operate a working tool attached to the boom;

a boom control valve to hydraulically control the boom cylinder;

a leveling control valve to hydraulically control the working tool cylinder to perform a leveling operation of the working tool to keep the working tool in a leveled position during the upward or downward motion of the boom;

a working tool control valve to hydraulically control the working tool cylinder to perform an operation of the working tool other than the leveling operation of the working tool by the leveling control valve;

a first supply line connecting the boom control valve to the bottom-side fluid chamber of the boom cylinder;

a second supply line connecting the boom control valve to the rod-side fluid chamber of the boom cylinder;

a leveling switch valve provided at an intermediate portion of the second supply line so as to divide the second supply line into a first section connected to the rod-side fluid chamber of the boom cylinder and a second section connected to the boom control valve, the leveling switch valve having:

a first operating position where the leveling switch valve supplies operation fluid in the first section of the second supply line from the rod-side fluid chamber of the boom cylinder to the leveling control valve so as to allow the leveling control valve to hydraulically control the working tool cylinder to perform the leveling operation of the working tool; and a first operation-stopping position where the leveling switch valve does not allow the leveling control valve to hydraulically control the working tool cylinder to perform the leveling operation of the working tool;

a first branched fluid line branched from the first section of the second supply line to the leveling control valve;

a second branched fluid line branched from the first supply line;

a ride controller including:

a ride-control switch valve connected to the second branched fluid line; and an accumulator connected to the ride-control switch valve and configured to perform an anti-vibrating operation for reducing a pressure fluctuation of the boom cylinder; and a drain fluid line connected to the leveling switch valve to drain operation fluid from the leveling switch valve to a portion other than the second supply line and the first branched fluid line; wherein:

the leveling switch valve, when in the first operating position, allows the operation fluid in the first section from the rod-side fluid chamber of the boom cylinder to be supplied via the first branched fluid line to the leveling control valve instead of the second section and the drain fluid line; and the leveling switch valve, when in the first operation-stopping position, allows at least a part of the operation fluid at least in the first section of the second supply line to be drained via the drain fluid line.

2. The hydraulic system according to claim 1, wherein the drain fluid line is provided with a throttle.

3. The hydraulic system according to claim 2, wherein the leveling switch valve includes:

a first port connected to the first section of the second supply line;

a second port connected to the second section of the second supply line; and a third port joined to the drain fluid line, the leveling switch valve, when in the first operation-stopping position, fluidly connects the first port, the second port, and the third port to each other to allow flow of the operation fluid between the first port and the second port and diversion flow of the operation fluid through the third port from the flow between the first port and the second port, and the leveling switch valve, when in the first operation position, prevents at least flow of the operation fluid from the first port to the second port.

4. The hydraulic system according to claim 3, wherein the drain fluid line includes:

an external drain fluid line outside of the leveling switch valve; and an inner drain fluid line made inside of the leveling switch valve and joined to the external drain fluid line, and, when the leveling switch valve is in the first operation-stopping position, the inner drain fluid line diverges a part of the operation fluid from the flow of the operation fluid through the leveling switch valve between the first section and the second section and discharges the part of the operation fluid into the external drain fluid line.

5. The hydraulic system according to claim 4, wherein the leveling switch valve includes a check valve to prevent the operation fluid in the first section from flowing to the second section when the leveling switch valve is in the first operating position.

6. The hydraulic system according to claim 3, wherein the leveling switch valve includes a check valve to prevent the operation fluid in the first section from flowing to the second section when the leveling switch valve is in the first operating position.

7. The hydraulic system according to claim 2, wherein the drain fluid line includes:

an external drain fluid line outside of the leveling switch valve; and an inner drain fluid line made inside of the leveling switch valve and joined to the external drain fluid line, and, when the leveling switch valve is in the first operation-stopping position, the inner drain fluid line diverges a part of the operation fluid from the flow of the operation fluid through the leveling switch valve between the first section and the second section and discharges the part of the operation fluid into the external drain fluid line.

8. The hydraulic system according to claim 7, wherein the leveling switch valve includes a check valve to prevent the operation fluid in the first section from flowing to the second section when the leveling switch valve is in the first operating position.

9. The hydraulic system according to claim 2, wherein the leveling switch valve includes a check valve to prevent the operation fluid in the first section from flowing to the second section when the leveling switch valve is in the first operating position.

10. The hydraulic system according to claim 2, wherein the ride-control switch valve has:

a second operation-stopping position where the ride-control switch valve does not allow the accumulator to perform the anti-vibrating operation; and a second operating position where the ride-control switch valve allows the accumulator to perform the anti-vibrating operation, and the leveling switch valve switches to the first operation-stopping position when the ride-control switch valve is switched to the second operating position.

11. The hydraulic system according to claim 1, wherein the leveling switch valve includes:

a first port connected to the first section of the second supply line;

a second port connected to the second section of the second supply line; and a third port joined to the drain fluid line, the leveling switch valve, when in the first operation-stopping position, fluidly connects the first port, the second port, and the third port to each other to allow flow of the operation fluid between the first port and the second port and diversion flow of the operation fluid through the third port from the flow between the first port and the second port, and the leveling switch valve, when in the first operation position, prevents at least flow of the operation fluid from the first port to the second port.

12. The hydraulic system according to claim 11, wherein the drain fluid line includes:

an external drain fluid line outside of the leveling switch valve; and an inner drain fluid line made inside of the leveling switch valve and joined to the external drain fluid line, and, when the leveling switch valve is in the first operation-stopping position, the inner drain fluid line diverges a part of the operation fluid from the flow of the operation fluid through the leveling switch valve between the first section and the second section and discharges the part of the operation fluid into the external drain fluid line.

13. The hydraulic system according to claim 12, wherein the leveling switch valve includes a check valve to prevent the operation fluid in the first section from flowing to the second section when the leveling switch valve is in the first operating position.

14. The hydraulic system according to claim 11, wherein the leveling switch valve includes a check valve to prevent the operation fluid in the first section from flowing to the second section when the leveling switch valve is in the first operating position.

15. The hydraulic system according to claim 1, wherein the drain fluid line includes:

an external drain fluid line located outside of the leveling switch valve; and an inner drain fluid line made inside of the leveling switch valve and joined to the external drain fluid line, and, when the leveling switch valve is in the first operation-stopping position, the inner drain fluid line diverges a part of the operation fluid from the flow of the operation fluid through the leveling switch valve between the first section and the second section and discharges the part of the operation fluid into the external drain fluid line.

16. The hydraulic system according to claim 15, wherein the leveling switch valve includes a check valve to prevent the operation fluid in the first section from flowing to the second section when the leveling switch valve is in the first operating position.

17. The hydraulic system according to claim 1, wherein the leveling switch valve includes a check valve to prevent the operation fluid in the first section from flowing to the second section when the leveling switch valve is in the first operating position.

18. The hydraulic system according to claim 1, wherein the ride-control switch valve has:

a second operation-stopping position where the ride-control switch valve does not allow the accumulator to perform the anti-vibrating operation; and a second operating position where the ride-control switch valve allows the accumulator to perform the anti-vibrating operation, and the leveling switch valve switches to the first operation-stopping position when the ride-control switch valve is switched to the second operating position.

19. The hydraulic system according to claim 18, wherein the leveling switch valve includes a first biasing member to bias the leveling switch valve toward the first operating position, and the ride-control switch valve includes a second biasing member to bias the ride-control switch valve toward the second operation-stopping position.

* * * * *